United States Patent [19]

Heaney et al.

[11] Patent Number: 4,660,734

[45] Date of Patent: Apr. 28, 1987

[54] STEAM TABLE PAN

[75] Inventors: Dennis J. Heaney, Sheboygan Falls; Wm. Bruce Reiter, Sheboygan, both of Wis.

[73] Assignee: The Vollrath Company, Sheboygan, Wis.

[21] Appl. No.: 848,736

[22] Filed: Apr. 4, 1986

[51] Int. Cl.[4] ..... B65D 1/44; B65D 1/46; B65D 6/34; B65D 21/12

[52] U.S. Cl. ..... 220/74; 206/518; 206/519; 220/72

[58] Field of Search ..... 220/72, 73, 74; 229/2.5 R; 206/518, 519

[56] References Cited

U.S. PATENT DOCUMENTS

| | | | |
|---|---|---|---|
| D. 191,565 | 10/1961 | Wolf et al. . | |
| D. 202,964 | 11/1965 | Benes . | |
| 2,128,297 | 8/1938 | Ingersoll . | |
| 2,170,040 | 8/1939 | Stuart . | |
| 2,656,066 | 10/1953 | Riemenschneider | 220/74 |
| 2,673,003 | 3/1954 | Stewart . | |
| 2,738,915 | 3/1956 | St. Clair | 229/2.5 R |
| 3,098,597 | 7/1963 | Johnson | 220/74 |
| 3,179,287 | 4/1965 | Richmeier | 220/94 R |
| 3,233,812 | 2/1966 | Kennedy | 206/518 |
| 3,420,431 | 1/1969 | Donovan . | |
| 3,451,588 | 6/1969 | Weber | 220/74 |
| 3,558,002 | 1/1971 | Lindgren . | |
| 3,563,445 | 2/1971 | Clayton . | |
| 3,583,623 | 6/1971 | Golner et al. . | |
| 3,700,096 | 12/1972 | Reifers . | |
| 3,884,383 | 5/1975 | Burch | 220/74 |
| 3,938,727 | 2/1976 | Andersson | 229/2.5 R |
| 4,113,095 | 9/1978 | Dietz et al. . | |

FOREIGN PATENT DOCUMENTS

| | | | |
|---|---|---|---|
| 1253019 | 12/1969 | France | 229/2.5 R |
| 145720 | of 1909 | United Kingdom | 206/519 |

*Primary Examiner*—George E. Lowrance

*Attorney, Agent, or Firm*—Dressler, Goldsmith, Shore, Sutker & Milnamow, Ltd.

[57] ABSTRACT

A steam table pan having a reinforcing gusset in the flange corner segment that rigidifies the corner segment thereby better retaining the configuration of the corner segment.

9 Claims, 9 Drawing Figures

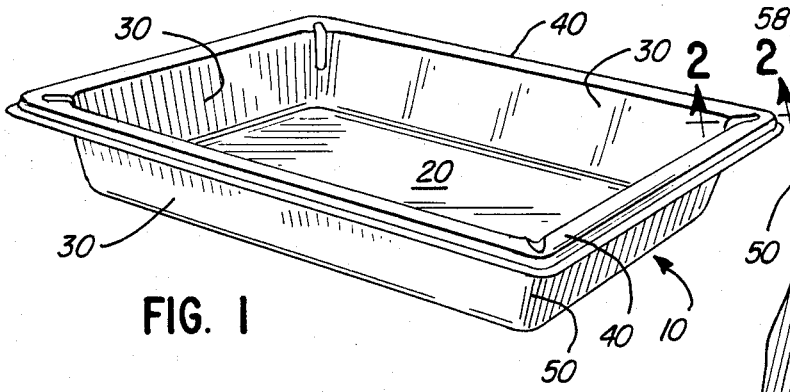
FIG. 1
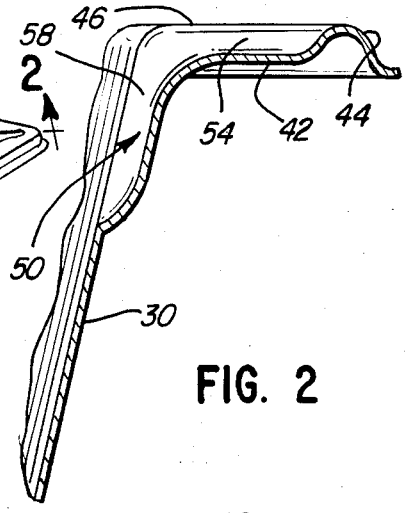
FIG. 2
FIG. 3
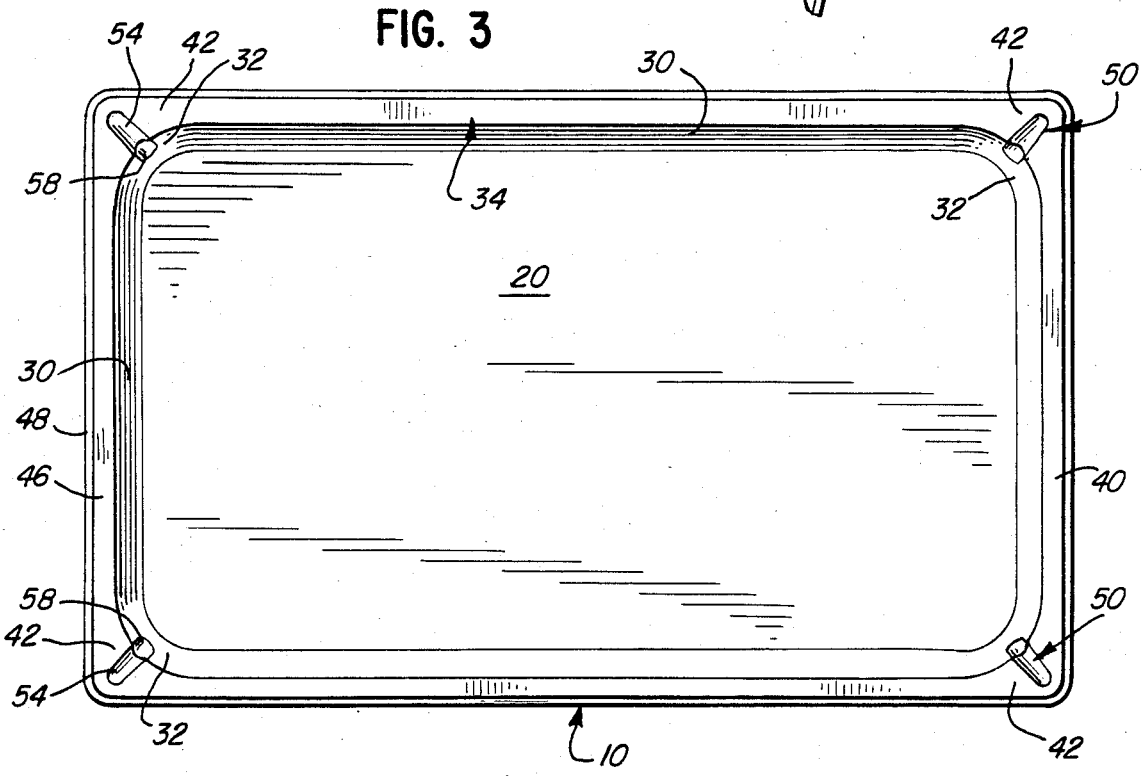
FIG. 4
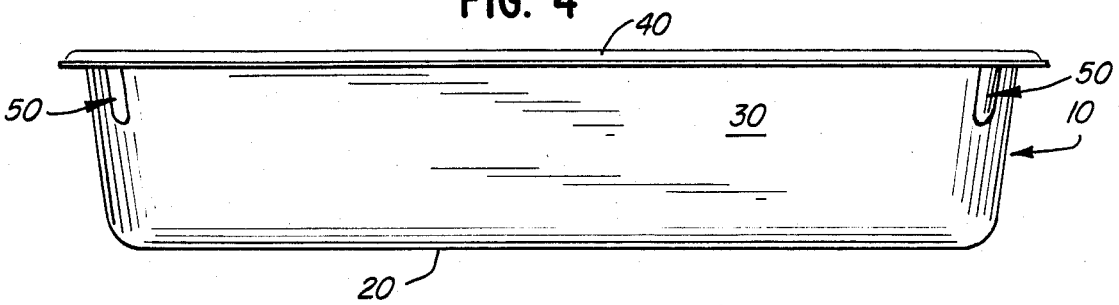

FIG. 5
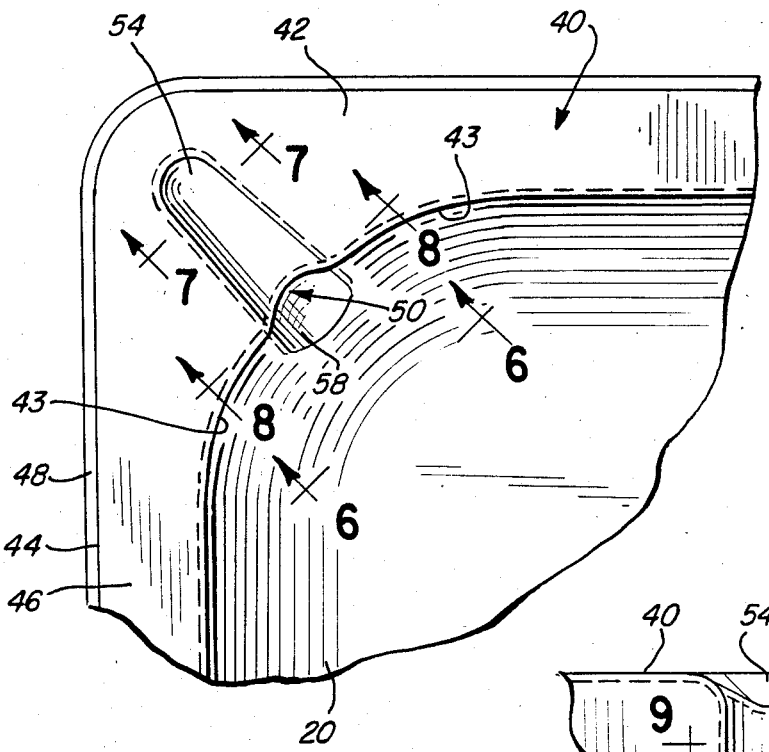
FIG. 6
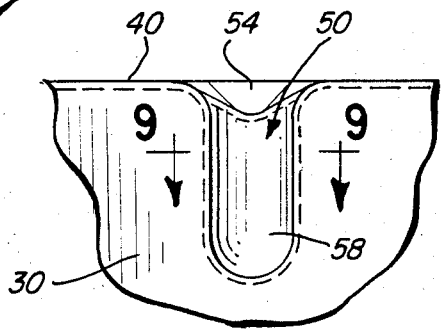
FIG. 7
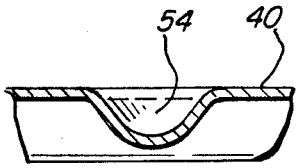
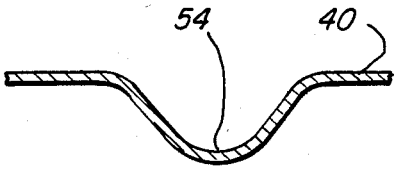
FIG. 8
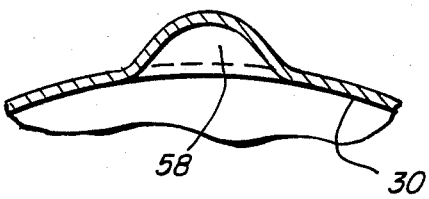
FIG. 9

STEAM TABLE PAN

TECHNICAL FIELD

The present invention relates to pans and in particular to steam table pans.

BACKGROUND OF THE INVENTION

The corners of steam table pans receive rough treatment. They are frequently dropped and the corners tend to roll over. When this occurs, the pan no longer properly seals an opening in a steam table, allowing steam to escape from the unsealed portion of the opening.

Those in the industry have sought without success to solve the problem by attempting to develop a tool that might be used to straighten out the bent over corners.

Another problem with steam table pans results from pinching the metal along the downturned outer edge of the top flange during the manufacturing process. That pinching tends to leave both burrs and a sharpened edge which requires post-treatment to eliminate. A type of construction has been developed in Europe in which the outer edge of the flange is out-turned and extends generally parallel to the pan bottom. That construction apparently avoids the pinching of the outer edge and is more effectively deburred. Further, that construction produces somewhat greater strength or reinforcement. Nevertheless, the problem of bent and rolled over corners has remained.

SUMMARY OF THE INVENTION

It has now been found that a reinforcing gusset located in each of the corner segments of the flange at the top of the pans rigidifies the corner segments and mitigates the tendency of the corner segments to roll over when pans are dropped or otherwise abused.

The present invention contemplates a multi-sided open top, metal pan comprising a generally rectangular, planar bottom panel, four sidewalls extending upwardly from the bottom panel and a top flange formed with the sidewalls and extending outwardly from the upper edges of the sidewalls. The sidewalls each merge with each adjacent sidewall in a curved corner and together define a top opening which is generally rectangular in plan view but which has rounded corners. The intersection of the flange with the upper edges of the sidewalls is curved. Each corner of the flange defines a corner segment. The flange and the sidewalls at each corner define a reinforcing gusset to rigidify the flange corner segment. The gusset comprises a first component in the flange corner segment and a second component in the curved corner of the sidewalls that merges with the first component. The components intersect at an angle of from about 90 degrees to about 135 degrees. Each component is longer than it is wide.

In a preferred embodiment the gusset comprises a generally rounded groove that is concave relative to the top of the pan and divides the flange corner segment into two parts of substantially the same size.

The steam table pans of this invention have reinforcing gussets that rigidify the flange corner segments. The reinforcement better retains the corner configuration and mitigates the tendency of the corner segments to roll over causing the pans to seal improperly when placed in a steam table. The mitigation of that tendency thereby extends the useful life of the pans.

The gusset additionally facilitates the ability to separate stacked steam table pans. Those pans are frequently stacked when they are hot and wet and tend to be difficult to denest when they cool. The reinforcing gusset enhances the ability to denest the pans. The gusset can also function as a pouring spout.

BRIEF DESCRIPTION OF THE DRAWINGS

FIG. 1 is a perspective view of a steam table pan of this invention;

FIG. 2 is an enlarged, fragmentary cross-sectional view thereof taken along the line 2—2 of FIG. 1;

FIG. 3 is a top plan view of the pan of FIG. 1;

FIG. 4 is a side elevational view of the pan of FIG. 1;

FIG. 5 is an enlarged, fragmentary, top plan view of a corner of the pan of FIG. 1;

FIG. 6 is an enlarged fragmentary elevational view of an inside portion of the corner of FIG. 5 taken along the line 6—6 of FIG. 5;

FIG. 7 is a fragmentary cross-sectional view taken along the line 7—7 of FIG. 5; FIG. 8 is a fragmentary, cross-sectional view taken along line 8—8 of FIG. 5; and FIG. 9 is an enlarged, fragmentary, cross-sectional view taken along the line 9—9 of FIG. 6.

DETAILED DESCRIPTION OF PREFERRED EMBODIMENTS

The present invention contemplates a steam table pan having reinforcing gussets that rigidify the pan corners.

FIG. 1 illustrates a multi-sided open top, metal, steam table pan 10 of this invention. Pan 10 comprises generally rectangular planar bottom panel 20, four sidewalls 30 extending upwardly from bottom panel 20 and top flange 40 which is formed with sidewalls 30 and which extends outwardly from the upper edges of sidewalls 30. Sidewalls 30 each merge in each adjacent sidewall 30 in a curved corner, such as corner 32. Sidewalls 30 define a top opening 34 which is generally rectangular in plan view but which has rounded corners and is best illustrated in FIG. 3.

As shown in FIG. 2, the intersection of flange 40 with the upper edges of sidewalls 30 is curved. Each corner of flange 40 defines a corner segment, such as corner segment 42. Flange 40 and sidewalls 30 at each corner as viewed from the exterior of the pan define a reinforcing gusset, such as gusset 50. Each gusset rigidifies its corresponding corner segment and defines a concave groove relative to the interior of the pan.

FIG. 5 illustrates corner segment 42. Formation of the gusset produces a double radius on the interior edge of the flange corner segment. Therefore, rather than having a continuous, single radius at the corner of the pan, there is a radius at each side of the gusset top plan view, providing a pair of arcuate sections 43 having different centers of curvature. That change in radius provides for better standoff of the pans, one relative to another when stacked. Steam table pans are frequently stacked when they are hot and wet and tend to be difficult to denest when they cool. The shape of the corner due to formation of the gusset in the corner thereby facilitates denesting of nested pans.

Further, the groove in the corner enhances airflow through the pan even when pans are stacked, as is frequently done after washing the pans. That airflow prevents steam table pans of this invention from forming a vacuum seal between stacked pans as the hot, wet pans cool.

Referring to FIG. 2, the reinforcing gussets of pans of this invention, such as gusset 50, comprise first component 54 in flange corner segment 42 and second component 58 in the curved corner of the sidewalls. First component 54 merges with second component 58, intersecting that component at an angle of from about 90 degrees to about 135 degrees. In a preferred embodiment the angle substantially corresponds to the angle formed by the intersection of sidewall 30 with top flange 40. In another preferred embodiment that angle is about 90 degrees. The 90 degree angle is particularly well suited to maximize the ability to denest stacked pans.

Each component is longer than it is wide. The depth of the compoents must be limited to ensure that the pan fits properly into the steam table. Therefore, the depth of the first component is limited in that the gusset 50 cannot extend below the level of the portion of the flange that seals the pan to the steam table. The depth of the second component must not extend the gusset 50 so that it interferes with fitting the pan into the opening in the steam table.

The gussets divide each flange corner segment into two parts of substantially the same size in a preferred embodiment. Further, first component 54 is greater than half the length of a line bisecting flange corner segment 42. Second component 58 is preferably of substantially the same length as first component 54.

When viewed from the interior of the pan 10, gusset 50 comprises a concave groove relative to the top of the pan. The groove is preferably generally rounded. FIGS. 5 through 9 illustrate a gusset of a preferred embodiment of the pan. As seen in those figures, the groove of first component 54 is generally hemispherical in cross-section at an end closest to the interior of the pan (See FIG. 8).

As illustrated in FIG. 8 the edges of the groove round smoothly into the upper surface of flange 40. The depth of the first component 54 of the groove gradually changes and becomes a feathered edge at the end of the groove nearest the outer edge of the flange corner segment, as best viewed in FIGS. 2 and 5. The groove gradually increases in depth from the outer edge of the flange to the interior edge of the flange corner segment (Compare FIGS. 7 and 8, and see FIG.2). The groove gradually decreases in depth from the intersection of the first and second components of the gusset to the end of the second component nearest the bottom of the pan. As seen in FIGS. 2 and 6, second component 58 is of substantially the same size and shape as first component 54.

Additionally, the gusset is relatively wide, thereby complying with National Sanitary Foundation requirements, and may also function as a pouring spout.

In a most preferred embodiment flange 40 includes a first outwardly extending planar portion 46 that is substantially parallel to the plane of the bottom panel 20. First outwardly extending portion 46 terminates in downwardly extending skirt 44 which in turn terminates in an outwardly extending portion 48 lying in a plane that is substantially parallel to the plane defined by bottom panel 20. As can be seen in FIG. 3, the first outwardly extending portion 46 extends a first distance that is substantially less than the distance extended by second outwardly extending portion 48.

Flange 40 is relatively flat. Outwardly extending portion 48 allows the user to grip the flattened edge of the pan. Formerly the user was forced to rest the downwardly turned outer edges of the flanges of such pans on his or her fingertips. The edges provided a poor grip and cut into the fingertips. Flange 40 evenly distributes the weight of the pan across a greater area of the user's fingers providing a better, and more comfortable, grip on the pan.

Further, the flattened edge provides for better sealing of the pan into the steam table. The improved seal holds in steam or cold air thereby providing more consistent temperatures. The pans need to be refilled less often, saving time and energy.

As will be recognized by those skilled in the art, other embodiments of a steam table pan of this invention can differ, particularly in the height of the sidewalls and length of the sides of the rectangle generally defined by the bottom panel relative to each other. Pans of this invention can be made of various gauges of metal in standardized content capacities. In addition to their use in a steam table, the pans of this invention are suitable for cooking, storing, freezing or displaying food.

Steam table pans of this invention may be formed by drawing a flat rectangular sheet or blank of metal into the desired shape, utilizing, for example, a double action press.

The present invention has been described with respect to preferred embodiments. It will be clear to those skilled in the art that modifications and/or variations of the disclosed steam table pans can be made without departing from the scope of the invention set forth herein.

We claim:

1. A reusable, long-lived, multi-sided, sanitary open top, metal steam table pan comprising, a generally rectangular planar bottom panel, four sidewalls extending upwardly from said bottom panel and defining a top opening which is generally rectangular in plan view, but which has rounded corners, said sidewalls each merging in each adjacent sidewall in a curved corner, and a top flange formed with said sidewalls and extending outwardly from the upper edges of said sidewalls, the intersection of said flange and said upper edges being curved, each corner of the flange defining a flange corner segment, said flange and said sidewalls at each corner defining a reinforcing and denesting gusset to rigidify the flange corner segment and to facilitate denesting of nested pans, said gusset comprising a first component in the flange corner segment and merging with a second component in said curved corner of said sidewalls, said components being of similar size and shape and intersecting at an angle of from about 90 degrees to about 135 degrees and each component being longer than it is wide, said first component being greater in length than one-half the length of a line bisecting said flange corner segment, said gussets being relatively wide throughout substantially their entire lengths.

2. The pan in accordance with claim 1 wherein each of said gussets divides said flange corner segment into two parts of substantially the same size.

3. The pan in accordance with claim 2 wherein the interior edge of said flange corner segment has a double radius in top plan view.

4. The pan in accordance with claim 2 wherein said second component is of substantially the same length as said first component.

5. The pan in accordance with claim 1 wherein said gusset defines a concave groove relative to the top of the pan.

6. The pan in accordance with claim 5 wherein said groove is generally rounded and gradually increases in depth from the outer edge of said flange corner segment to the interior edge of said flange corner segment and decreases in depth from the intersection of the first and second components to the end of said second component nearest the bottom of said pan.

7. The pan in accordance with claim 1 wherein said flange is generally flat and lies in a plane that is substantially parallel to the plane defined by said bottom panel.

8. The pan in accordance with claim 7 wherein said top flange includes a first outwardly extending portion defining a plane that is substantially parallel to the plane defined by said bottom panel terminating in a downwardly extending skirt which in turn terminates in an outwardly extending portion defining in a plane that is substantially parallel to the plane defined by said bottom panel, said portion extending outwardly a first distance and said second outwardly extending portion extending a distance that is substantially less than said first distance.

9. A multi-sided open top, metal pan comprising a generally rectangular planar bottom panel, four sidewalls extending upwardly from said bottom panel and defining a top opening which is generally rectangular in plan view, but which has rounded corners, said sidewalls each merging in each adjacent sidewall in a curved corner, and a top flange formed with said sidewalls and extending outwardly from the upper edges of said sidewalls, the intersection of said flange and said upper edges being curved, said top flange including a generally flat, first outwardly extending portion defining a plane that is substantially parallel to the plane defined by said bottom panel terminating in a downwardly extending skirt which in turn terminates in an outwardly extending portion defining in a plane that is substantially parallel to the plane defined by said bottom panel, said first portion extending outwardly a first distance and said second outwardly extending portion extending a distance that is substantially less than said first distance, each corner of the flange defining a flange corner segment, said flange and said sidewalls at each corner defining a reinforcing gusset to rigidify the flange corner segment, an interior edge of said flange corner segment having a double radius in top plan view, said gusset comprising a first component in the flange corner segment that divides said flange corner segment into two parts of substantially the same size and merging with a second component in said curved corner of said sidewalls, said components intersecting at an angle of from about 90 degrees to about 135 degrees and each component being longer than it is wide, said first component of said gusset being greater than half the length of a line bisecting said flange corner segment and said second component being of substantially the same length as said first component, said gusset defining a generally rounded, concave groove relative to the top of said pan, said groove gradually increasing in depth from the outer edge of said flange corner segment to the interior edge of said flange corner segment and decreasing in depth from the intersection of the first and second components to the end of said second component nearest the bottom of said pan.

* * * * *

UNITED STATES PATENT AND TRADEMARK OFFICE

CERTIFICATE OF CORRECTION

PATENT NO. : 4,660,734

DATED : April 28, 1987

INVENTOR(S) : Dennis J. Heaney and Wm. Bruce Reiter

It is certified that error appears in the above-identified patent and that said Letters Patent is hereby corrected as shown below:

Column 5, line 25, insert --first-- after "said".

Signed and Sealed this

Twenty-fifth Day of August, 1987

*Attest:*

DONALD J. QUIGG

*Attesting Officer*

*Commissioner of Patents and Trademarks*